US008087219B2

(12) United States Patent
Liu et al.

(10) Patent No.: US 8,087,219 B2
(45) Date of Patent: Jan. 3, 2012

(54) VACUUM PACKAGING SYSTEM

(75) Inventors: Peng Liu, Beijing (CN); Pi-Jin Chen, Beijing (CN); Bing-Chu Du, Beijing (CN); Cai-Lin Guo, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 180 days.

(21) Appl. No.: 12/469,829

(22) Filed: May 21, 2009

(65) Prior Publication Data

US 2009/0288363 A1 Nov. 26, 2009

(30) Foreign Application Priority Data

May 23, 2008 (CN) ..... 2008 1 0067428

(51) Int. Cl.
*B65B 31/00* (2006.01)

(52) U.S. Cl. ..... 53/510; 53/110

(58) Field of Classification Search ..... 53/510, 53/509, 79, 80, 110, 127
See application file for complete search history.

(56) References Cited

U.S. PATENT DOCUMENTS 3,477,192 A * 11/1969 Brown et al. ..... 53/432
3,826,634 A 7/1974 Blust et al.
3,830,365 A * 8/1974 Krueger et al. ..... 206/471
3,910,008 A * 10/1975 Johnson ..... 53/509
3,914,000 A 10/1975 Beckerman et al.
3,926,306 A 12/1975 Van Nederveen
4,418,511 A * 12/1983 Collin ..... 53/427
4,582,210 A 4/1986 Morimoto et al.
4,748,797 A * 6/1988 Martin ..... 53/432
4,770,310 A 9/1988 Morimoto et al.
5,072,574 A 12/1991 Puett
5,269,351 A * 12/1993 Yoshihara ..... 141/7
5,271,207 A * 12/1993 Epstein et al. ..... 53/432
5,587,622 A 12/1996 Mohacsi
5,759,668 A 6/1998 Ishikawa et al.
5,797,780 A 8/1998 Peng
5,896,727 A * 4/1999 Egli et al. ..... 53/426
5,921,837 A 7/1999 Kanagawa et al.
5,964,630 A 10/1999 Slusarczuk et al.
6,147,450 A 11/2000 Fritz et al.
6,416,831 B1 7/2002 Hara et al.
6,457,299 B1 * 10/2002 Schwenke et al. ..... 53/510

(Continued)

FOREIGN PATENT DOCUMENTS

JP 62259329 11/1987

(Continued)

*Primary Examiner* — Sameh H. Tawfik
(74) *Attorney, Agent, or Firm* — Altis Law Group, Inc.

(57) ABSTRACT

A vacuum packaging system for packaging a vacuum apparatus includes a first accommodating room, a second container, a vacuum room, a first hatch, a second hatch, a delivery apparatus, a discharge device, and a heating apparatus. The delivery apparatus transports the vacuum apparatus from the first accommodating room to the vacuum room to the second accommodating room. The discharge device discharges a sealing element to seal an exhaust through hole of the vacuum apparatus. The heating apparatus is mounted on the inner wall of the vacuum room between the second hatch and the transport pipeline to heat and soften the sealing element.

12 Claims, 2 Drawing Sheets

U.S. PATENT DOCUMENTS

| | | | | |
|---|---|---|---|---|
| 6,735,845 | B2 | 5/2004 | Jonsson | |
| 6,748,726 | B2 * | 6/2004 | Rossi et al. | 53/510 |
| 6,843,043 | B2 * | 1/2005 | Hanson et al. | 53/510 |
| 7,055,298 | B2 * | 6/2006 | Rossi et al. | 53/511 |
| 7,081,029 | B2 | 7/2006 | Tagawa et al. | |
| 7,758,396 | B2 | 7/2010 | Okawa et al. | |
| 2009/0288364 | A1 * | 11/2009 | Liu et al. | 53/80 |

FOREIGN PATENT DOCUMENTS

| | | |
|---|---|---|
| JP | 63116336 | 5/1988 |
| JP | 63207032 | 8/1988 |
| JP | 63284742 | 11/1988 |
| JP | 11306983 | 11/1999 |
| JP | 2000208051 | 7/2000 |
| JP | 2000215791 | 8/2000 |

* cited by examiner

<RELATED ART>

VACUUM PACKAGING SYSTEM

RELATED APPLICATIONS

This application is related to commonly-assigned applications entitled, "VACUUM PACKAGING SYSTEM", filed currently 12/469,833. The disclosures of the above-identified applications are incorporated herein by reference.

BACKGROUND

1. Technical Field

The present disclosure relates to packaging systems and, in particular, to a vacuum packaging system for forming a seal on a vacuum device.

2. Description of Related Art

Some vacuum devices, such as flat panel displays, are packaged by a vacuum packaging system to create a vacuum within such devices. Referring to FIG. 2, according to the prior art, a typical vacuum packaging system 300 is shown. The typical vacuum packaging system 300 includes a vacuum room 30, a first accommodating room 31 and a second accommodating room 32 disposed at opposite sides of the vacuum room 30, a delivery device 35, and a condensing-light sealing device 36 connected to the vacuum room 30. The first accommodating room 31 and the second accommodating room 32 communicate with the vacuum room 30 via a first hatch 33 and a second hatch 34. The delivery device 35 can carry workpieces to be packaged between the first and second accommodating rooms 31, 32. The condensing-light sealing device 36 is located outside the vacuum room 30 and emits a laser to package the workpieces.

A typical packaging method utilizing the above vacuum packaging system 300 includes the following steps. A pre-packaged container 37, that has an exhaust through hole 371 defined thereon, is prepared in the first accommodating room 31. An exhaust pipe 372 is provided. One end of the exhaust pipe 372 is inserted into and fixed in the exhaust through hole 371 via low-melting glass powder (not labeled), and another end of the exhaust pipe 372 is exposed outside the pre-packaged container 37. The condensing-light sealing device 36 heats and softens the exhaust pipe 372 so as to seal the open end thereof. The pre-packaged container 37 and the exhaust pipe 372 fixed on the pre-packaged container 37 are transported into the vacuum room 30 via the delivery device 35. The vacuum room 30 is connected to a vacuum pump 38 that is used to create a vacuum. The outer end of the exhaust pipe 372 is then sealed utilizing the condensing-light sealing device 36. The packaged container (not labeled) is cooled in the second accommodated room 32 to obtain a packaged container under vacuum.

However, the exhaust pipe 372 needs to be disposed in the through hole 371 of the pre-packaged container 37 in the above method. In addition, the exhaust pipe 372 is retained outside of the packaged container, which is disadvantageous with respect to safety and reliability. Furthermore, to expediently seal the end of the exhaust pipe 372, the exhaust pipe 372 should have a small diameter, for example, less than 5 mm, which results in more time to remove air from the pre-packaged container 37. Therefore, the structure of the packaged container becomes complicated and the manufacturing cost is increased.

What is needed, therefore, is a vacuum packaging system, which can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments.

DETAILED DESCRIPTION

Figure 1:
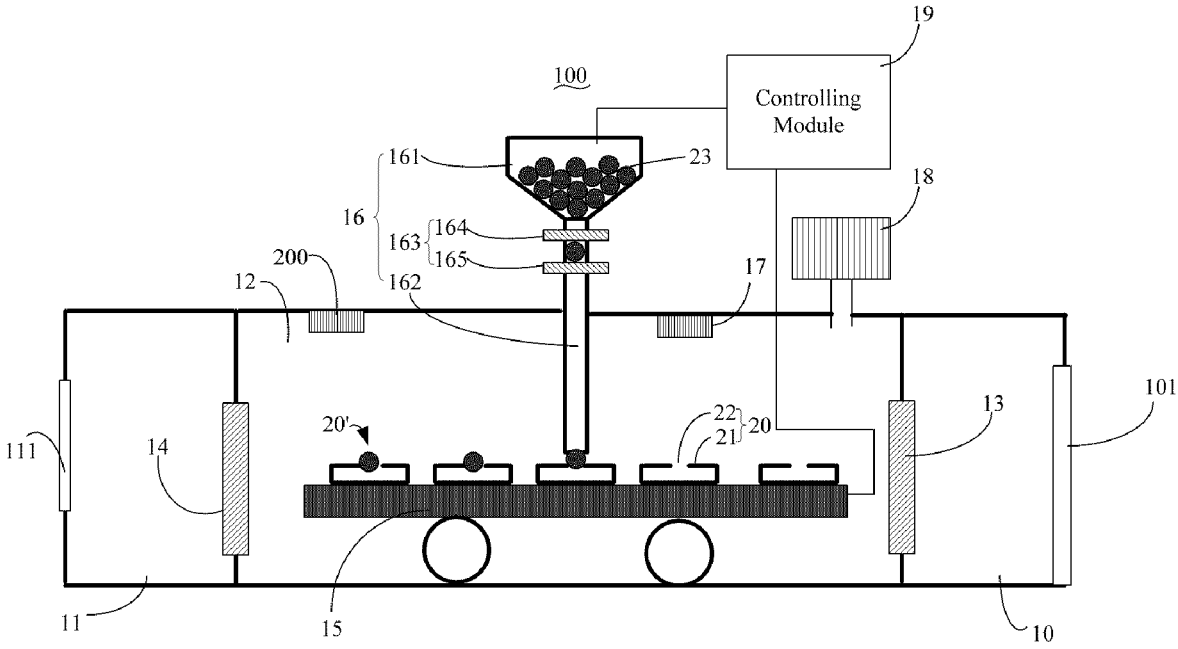
FIG. 1 is a schematic, cross-sectional view of an embodiment a vacuum packaging system.
Figure 2:
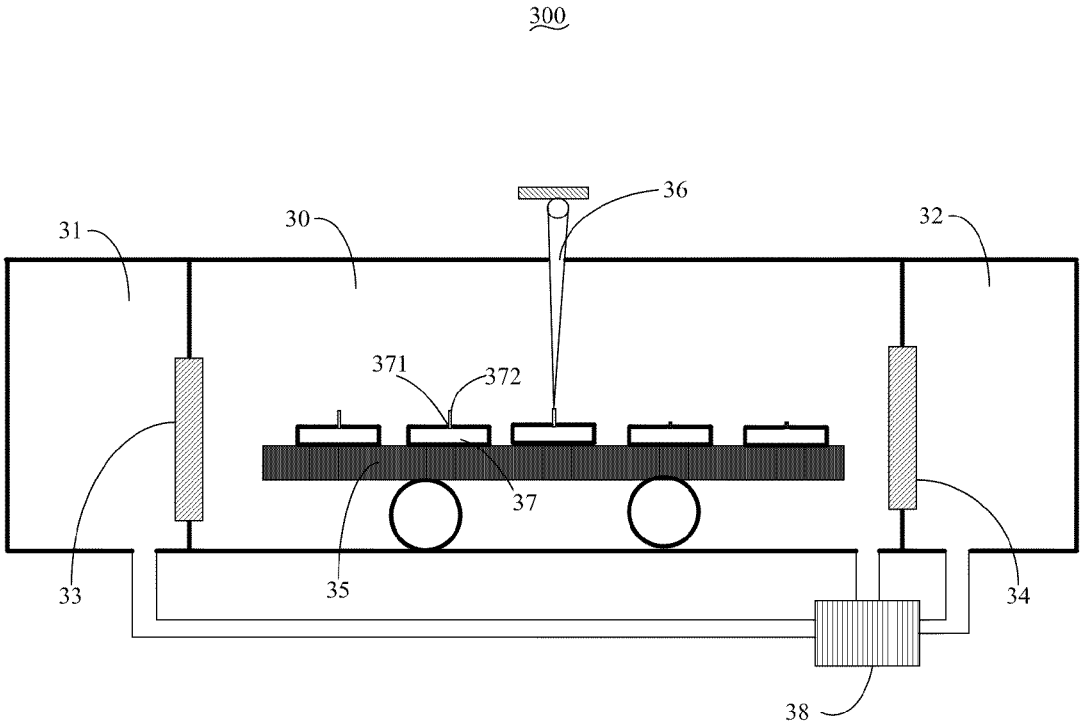
FIG. 2 is a schematic, cross-sectional view of a typical vacuum packaging system.

Referring to FIG. 1, an embodiment of a vacuum packaging system 100 includes a first accommodating room 10, a second accommodating room 11, a vacuum room 12, a first hatch 13, a second hatch 14, a delivery apparatus 15, a discharge device 16, and a first heating apparatus 17. The vacuum room 12 is sandwiched between the first accommodating room 10 and the second accommodating room 11. The first hatch 13 is interposed between the first accommodating room 11 and the vacuum room 12. The second hatch 14 is interposed between the second accommodating room 11 and the vacuum room 12. The delivery apparatus 15 is used to transport a plurality of pre-packaged containers 20 into the vacuum room 12 and a plurality of packaged containers 20' out of the vacuum room 12. The discharge device 16 is mounted on the vacuum room 12 with a part of the discharge device 16 extending into the vacuum room 12. The first heating apparatus 17 is disposed on an inner wall of the vacuum room 12.

Each pre-packaged containers 20 includes a housing 21 and an exhaust through hole 22 defined therein. The exhaust through hole 22 can be defined in any one sidewall of the housing 21. The housing 21 may be made of glass, metal, or any other material that can be adhered utilizing low-melting glass powder. In the present embodiment, the housing 21 is made of glass. The pre-packaged containers 20 can be, for example, an element of a flat panel display, and the housing 21 can include a rear plate, a front plate, and spacers disposed between the rear plate and the front plate. Some electronic elements (not shown) are contained in the housing 21. In the present embodiment, the housing 21 is comprised of glass. The exhaust through hole 22 can have any size and shape that is appropriate to the volume of the housing 21. In the present embodiment, the exhaust through hole 22 has a circular shape and has a diameter of about 2 mm to about 10 mm. However, it is understood that if the exhaust through hole 22 is too large of a diameter, a poor reliability would result.

The first accommodating room 10 includes a first door 101. The first door 101 allows the pre-packaged containers 20 to be fed into the first accommodating room 10 therethrough. The first accommodating room 10 is used for preparing the pre-packaged containers 20 therein.

The second accommodating room 11 includes a second door 111. The second door 111 allows the packaged containers 20' to exit from the second accommodating room 11 therethrough. The second accommodating room 11 is arranged to allow the packaged containers 20' to cool.

The vacuum room 12 is used for containing the delivery apparatus 15 and perform the heating, exhausting, and packaging of the pre-packaged containers 20 therein.

The first hatch 13 and the second hatch 14 have the same configurations and work principles. In the present embodiment, the first hatch 13 is presented only as an example to explain the configurations and the work principles thereof. The first hatch 13 may be an automatic door to communicate the first accommodating room 10 to the vacuum room 12. When the first hatch 13 is open, the first accommodating room 10 communicates with the vacuum room 12 so that the delivery apparatus 15 can enter the vacuum room 12. Once the delivery apparatus 15 is fully contained in the vacuum room 12, the first hatch 13 is closed, and the vacuum room 12 is sealed off from the first accommodating room 10 and becomes a sealed room. After packaging is finished, the second hatch 14 is opened such that the second accommodating room 11 communicates with the vacuum room 12, and the delivery apparatus 15 can exit the vacuum room 12 so that the packaged container 20' can be cooled in the second accommodating room 11. When the delivery apparatus 15 is completely in the second accommodating room 11, the second hatch 14 is closed so that the second accommodating room 11 is sealed off from the vacuum room 12.

The delivery apparatus 15 may be a tray having wheels and can be driven to transport the pre-packaged containers 20 and the packaged containers 20' from the first accommodating room 10 to the second accommodating room 11 via the vacuum room 12. The delivery apparatus 15 can carry more than one pre-packaged container 20 at one time so that the pre-packaged containers 20 can be packaged in batches in the vacuum room 12 to increase packaging efficiency.

The discharge device 16 includes a vessel 161, a transport pipeline 162 connected to the vessel 161, and a controlling element 163. The vessel 161 contains a plurality of sealing elements 23. The transport pipeline 162 is inserted through the vacuum room 12 and discharges sealing elements 23 for sealing the pre-packaged container 20. The controlling element 163 controls one of the sealing elements 23 to be transported into the vacuum room 12 and includes a first valve 164 and a second valve 165. The first and second valves 164, 165 are located in the transport pipeline 162 and spaced apart from each other. In use, the first valve 164 is opened first to allow one of the sealing elements 23 to enter into a space between the first valve 164 and the second valve 165. The first valve 164 is then closed to prevent other sealing elements 23 from entering between the first and second valves 164, 165. When the delivery apparatus 15 enters the vacuum room 12, the second valve 165 is opened to allow one sealing element 23 to be transported into the vacuum room 12 and cover the exhaust through hole 22 of the pre-packaged containers 20. The second valve 165 is closed after the sealing element 23 is ejected out of the discharge device 16.

The sealing element 23 forms a seal around the exhaust through hole 22 of the pre-packaged containers 20 and the sealing element 23. The sealing element 23 may have a plate shape and a greater area than that of the exhaust through hole 22 to completely cover the exhaust through hole 22. The sealing element 23 may be made of glass or metal and have a lower-melting glass powder placed along the periphery of the sealing element 23 manually or via a screen-printing method. The lower-melting glass powder has a lower melting point than that of the sealing element 23. During packaging, the low-melting glass powder is heated for a predetermined period of time so as to remove the air therein before mounting the sealing element 23.

The first heating apparatus 17 may be an electrically heating wire, an infrared light, or a laser. The first heating apparatus 17 is disposed between the transport pipeline 162 and the first hatch 13 to heat and soften the low-melting glass powder formed on the sealing element 23.

The vacuum packaging system 100 also includes a vacuum pump 18 connected to the vacuum room 12. When the delivery apparatus 15 enters into the vacuum room 12 and the first and second hatches 13, 14 are closed, the vacuum pump 18 generates a vacuum in the vacuum room 12, and in the pre-packaged containers 20.

Furthermore, the vacuum packaging system 100 can include a controlling module 19 electrically connected to the discharge device 16 and the delivery apparatus 15. The controlling module 19 controls the ejection time of the sealing element 23 and the location of the delivery apparatus 15 such that the exhaust through hole 22 of each of the pre-packaged containers 20 is perfectly sealed.

The vacuum packaging system 100 may include a second heating apparatus 200 disposed between the second hatch 14 and the transport pipeline 162. The second heating apparatus 200 bakes the pre-packaging containers 20 to further eject vapor gas out from the pre-packaged containers 20.

In use, when the delivery apparatus 15 enters into the vacuum room 12, the controlling module 19 controls the location of the pre-packaged containers 20, by aligning the exhaust through hole 22 with the transport pipeline 172. The controlling module 19 then controls the discharge device 16 to transport one sealing element 23 to seal the exhaust through hole 22. The first heating apparatus 17 heats and softens the low-melting glass powder of the sealing element 23 to form a seal between the exhaust through hole 22 and the sealing element 23. After all of the pre-packaged containers 20 have been packaged, the delivery apparatus 15 enters into the second accommodating room 11, where the packaged containers 20' are cooled. After the packaged containers 20' have been cooled, the packaged containers 20' are removed from the second accommodating room 12.

Since the sealing element 23 is used for sealing the exhaust through holes 22 of the pre-packaged containers 20, no tail of the exhaust pipe is retained outside of the packaged containers 20', which is advantageous in regards of safety and reliability. Furthermore, the vacuum packaging system 100 is appropriate for pipeline operations. Therefore, the structure of the vacuum apparatus is simple and safe and manufacturing costs are decreased.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A vacuum packaging system for packaging a pre-packaged container and establishing a vacuum in a packaged vacuum device, the packaged vacuum device including the pre-packaged container having an exhaust through hole defined thereon, and a sealing element, the vacuum packaging system comprising:

a vacuum room to package the pre-packaged container;

a delivery apparatus to transport the pre-packaged container into the vacuum room and transport the packaged vacuum device out of the vacuum room;

a discharge device comprising a vessel containing the sealing element, a transport pipeline connected to the vessel and partly inserted into the vacuum room, and a controlling element located on the transport pipeline to control the sealing element to be transported into the vacuum room via the transport pipeline;

a first heating apparatus mounted on an inner wall of the vacuum room to heat and soften the sealing element; and a second heating apparatus mounted on the inner wall of the vacuum room and spaced apart from the first heating apparatus, the second heating apparatus bakes the pre-packaged container to further eject vapor gas out from the pre-packaged container.

2. The vacuum packaging system of claim 1, wherein the first heating apparatus is selected from the group consisting of an electrically heating wire, an infrared light, and a laser.

3. The vacuum packaging system of claim 1, further comprising a vacuum pump connected to the vacuum room to generate a vacuum therein.

4. The vacuum packaging system of claim 1, wherein the sealing element has a plate shape.

5. The vacuum packaging system of claim 1, wherein the sealing element is made of glass or metal.

6. The vacuum packaging system of claim 1, further comprising a first accommodating room connected to the vacuum room and the first accommodating room comprising a first door to provide an entrance into the first accommodating room.

7. The vacuum packaging system of claim 1, further comprising a second accommodating room connected to the vacuum room and the second accommodating room comprising a second door to provide an exit to the outside for the packaged vacuum device from the second accommodating room therethrough.

8. The vacuum packaging system of claim 1, further comprising a first hatch disposed between the first accommodating room and the vacuum room to communicate the first accommodating room with the vacuum room.

9. The vacuum packaging system of claim 1, further comprising a second hatch disposed between the second accommodating room and the vacuum room to communicate the second accommodating room with the vacuum room.

10. The vacuum packaging system of claim 1, wherein the sealing element comprises a low-melting glass powder formed on the periphery thereof to adhere the sealing element to the pre-packaged container, the low-melting glass powder has a lower melting point than that of the sealing element.

11. The vacuum packaging system of claim 1, wherein the controlling element comprises a first valve and a second valve spaced apart from the first valve such that the sealing element can be positioned between the first valve and the second valve.

12. The vacuum packaging system of claim 1, further comprising a controlling module electrically connected to the discharge device and the delivery apparatus, the controlling device module to control the ejection time of the sealing element and the stop location of the delivery apparatus so that the sealing element is positioned on the exhaust through hole of the pre-packaged container.

* * * * *